US007814601B2

(12) United States Patent
Taggart et al.

(10) Patent No.: US 7,814,601 B2
(45) Date of Patent: Oct. 19, 2010

(54) VIBRATING HAIR BRUSH HAVING ISOLATOR SUPPORT SYSTEM FOR CONTROLLED VIBRATORY MOVEMENT

(75) Inventors: Jeffrey Silver Taggart, McLean, VA (US); Jeffrey M. Kalman, Cleveland Heights, OH (US); John R. Nottingham, Bratenahl, OH (US); John W. Spirk, Jr., Gates Mills, OH (US); Jay Tapper, Shaker Heights, OH (US); Rachel Marie Nottingham, Cleveland Heights, OH (US); Carolyn M. McNeeley, Fairview Park, OH (US); Richard Skinner, Wirral (GB); Brian Douglas Wall, Wirral (GB); Stephen Lee Wire, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 725 days.

(21) Appl. No.: 11/713,289

(22) Filed: Mar. 2, 2007

(65) Prior Publication Data

US 2008/0209648 A1 Sep. 4, 2008

(51) Int. Cl.
*A46B 13/08* (2006.01)

(52) U.S. Cl. ..... 15/21.1; 15/22.1; 15/22.2; 601/72

(58) Field of Classification Search ..... 15/21.1, 15/102.1, 102.2; 601/72; 301/72
See application file for complete search history.

(56) References Cited

U.S. PATENT DOCUMENTS

| | | | | |
|---|---|---|---|---|
| 358,309 | A | 2/1887 | Warde | |
| 2,465,250 | A | 3/1949 | McCready | 128/46 |
| 3,150,393 | A | 9/1964 | Taylor et al. | 15/23 |
| 3,204,469 | A | 9/1965 | Spillers | 74/22 |
| 3,272,023 | A | 9/1966 | Ferguson et al. | 74/55 |
| 3,358,309 | A | 12/1967 | Richardson | 15/22 |
| 3,384,096 | A | 5/1968 | Paccione | 132/11 |
| 3,517,235 | A | 6/1970 | Flowers et al. | 310/80 |
| 3,794,050 | A | 2/1974 | Gallanis et al. | 132/11 |

(Continued)

FOREIGN PATENT DOCUMENTS

| | | |
|---|---|---|
| DE | 36 04 009 | 8/1987 |

(Continued)

OTHER PUBLICATIONS

Co-pending application: Applicant: Taggert et al., U.S. Appl. No. 11/713,400, filed Mar. 2, 2007.

(Continued)

*Primary Examiner*—Monica S Carter
*Assistant Examiner*—Stephanie Newton
(74) *Attorney, Agent, or Firm*—Karen E. Klumas

(57) ABSTRACT

A vibrating hair brush provides enhanced detangling of user's hair. The brush has a bristle pad comprising a plurality of bristles disposed in a brush head. The bristle pad is supported within the brush head by a vibrating motor and isolator assembly disposed for directing a vibratory movement of the motor to a bristle pad movement in a plane generally parallel to a user's scalp. The motor and isolator assembly effectively translate a circular vibratory movement of the offset weight into an elliptical movement of the bristle pad while insulating the vibration caused by the movement of the weight from a handle of the brush.

10 Claims, 5 Drawing Sheets

U.S. PATENT DOCUMENTS

| | | | | | |
|---|---|---|---|---|---|
| 3,850,181 | A | | 11/1974 | Baker | 132/11 |
| 3,853,133 | A | | 12/1974 | Komatsu et al. | 132/11 |
| 3,897,794 | A | | 8/1975 | Branch | 132/11 |
| 4,139,014 | A | | 2/1979 | Rowland | 132/11 |
| 4,585,018 | A | | 4/1986 | O'Connor | 132/120 |
| 4,651,761 | A | | 3/1987 | Suen et al. | 132/148 |
| 5,078,157 | A | | 1/1992 | Golan et al. | 132/119 |
| 5,297,512 | A | | 3/1994 | Sharp | 119/86 |
| 5,343,881 | A | | 9/1994 | Golan et al. | 132/119.1 |
| 5,471,695 | A | | 12/1995 | Aiyar | 15/22.1 |
| 5,502,860 | A | | 4/1996 | Franke | 15/160 |
| 5,511,270 | A | * | 4/1996 | Eliachar et al. | 15/22.1 |
| 5,603,339 | A | | 2/1997 | Brazeal et al. | 132/119.1 |
| 5,622,192 | A | | 4/1997 | Chiou | 132/112 |
| 5,632,289 | A | | 5/1997 | Sharp | 132/116 |
| 5,647,841 | A | * | 7/1997 | Groenewold et al. | 601/114 |
| 5,915,391 | A | | 6/1999 | Revil | 132/119.1 |
| 5,918,607 | A | | 7/1999 | Zucker | 132/200 |
| 5,967,150 | A | | 10/1999 | Wright et al. | 132/119.1 |
| 6,575,173 | B2 | | 6/2003 | Quan et al. | 132/119.1 |
| 6,668,758 | B1 | | 12/2003 | Davis, Jr. | 119/608 |
| 6,997,889 | B1 | | 2/2006 | Thomas | 601/137 |
| 2007/0068546 | A1 | | 3/2007 | Lipawsky | 132/119.1 |

FOREIGN PATENT DOCUMENTS

| | | | |
|---|---|---|---|
| DE | 44 43 833 | | 5/1996 |
| EP | 0 232 819 | | 8/1987 |
| FR | 2 757 030 | | 6/1998 |
| GB | 2 411 588 | | 9/2005 |
| JP | 03-222 905 | | 10/1991 |
| JP | 03222905 | A * | 10/1991 |
| JP | 08 289816 | | 11/1996 |
| JP | 08-289816 | | 11/1996 |
| JP | 2004 065914 | | 3/2004 |
| JP | 2004-129959 | | 4/2004 |
| JP | 2004 129959 | | 4/2004 |
| JP | 2007 037978 | | 2/2007 |
| WO | 88/06852 | | 9/1988 |
| WO | 96/17534 | | 6/1996 |
| WO | 01/52689 | | 7/2001 |

OTHER PUBLICATIONS

PCT International Search Report in PCT application PCT/EP2008/051174.
PCT International Search Report in PCT application PCT/EP2008/051173.
PCT International Search Report in PCT application PCT/EP2008/051176.
PCT International Search Report in PCT application PCT/EP2008/051172.
EP Search Report in EP application EP 07 12 2067.
EP Search Report in EP application EP 07 12 2069.
EP Search Report in EP application EP 07 12 2071.
GB Search Report in GB application GB 0402199.4.
JP Abstract JP 03 222 905—published Oct. 1, 1991.
JP Abstract JP 2004 065914—published Mar. 4, 2004.
JP Abstract JP 2007 037978—published Feb. 15, 2007.
Co-pending Application: Applicant: Taggart et al., U.S. Appl. No. 12/074,010, filed Feb. 29, 2008.
Co-pending Application: Applicant: Taggart et al., U.S. Appl. No. 12/074,008, filed Feb. 29, 2008.
Co-pending Application: Applicant: Taggart et al., U.S. Appl. No. 12/074,007, filed Feb. 29, 2008.
Co-pending Application: Applicant: Taggart et al., U.S. Appl. No. 11/713,400, filed Mar. 2, 2007.
Co-pending Application: Applicant: Taggart et al., U.S. Appl. No. 12/074,002, filed Feb. 29, 2008.
Derwent Abstract of EP 0 232 819—published Aug. 19, 1987.
Derwent Abstract of WO 88/06852—published Sep. 22, 1988.
Derwent Abstract of WO 96/17534—published Jun. 13, 1996.
Derwent Abstract of FR 2 757 030—published Jun. 19, 1998.

* cited by examiner

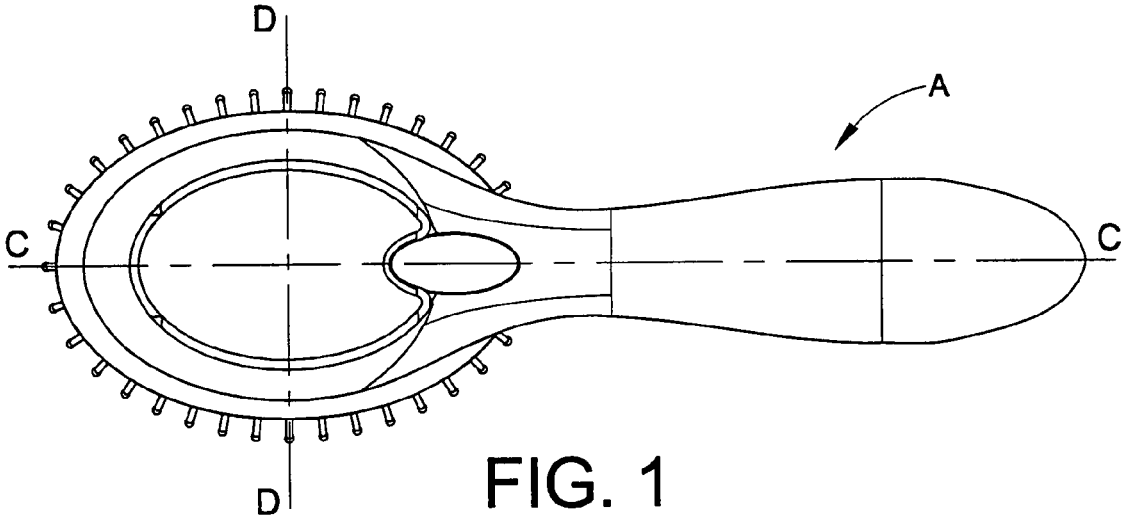
FIG. 1
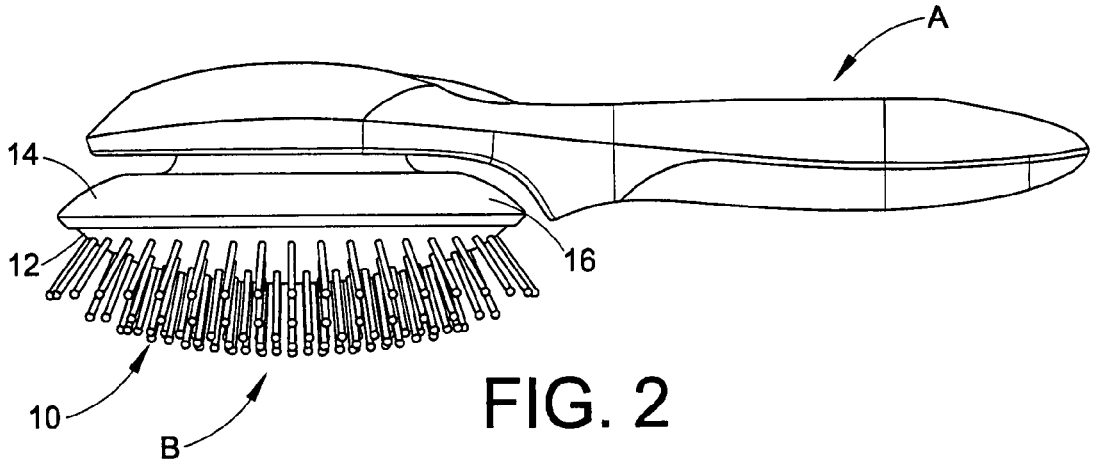
FIG. 2
FIG. 3
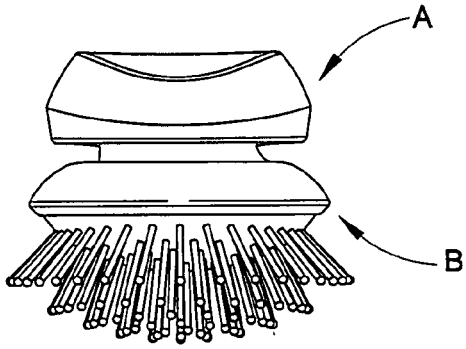

VIBRATING HAIR BRUSH HAVING ISOLATOR SUPPORT SYSTEM FOR CONTROLLED VIBRATORY MOVEMENT

TECHNICAL FIELD

The presently disclosed embodiments are directed to vibratory devices wherein gyratory movements are translated into pulses, typically for massage or cleaning, but in this case, for enhanced detangling of curled or unbrushed hair wherein brushing and detangling can occur with less effort and with less damage to the hair.

BACKGROUND

Vibrating brushes for human personal care are well known and are used where the vibration is intended to enhance brushing, cleaning or massaging effects. Vibrating hair brushes are also well known wherein a vibratory movement is applied to the bristles for an enhanced brushing or combing effect, and is usually also intended for a massaging effect to the scalp of the brushing user. For example, in U.S. Pat. No. 3,517,235 to Flowers et al., oppositely driven reciprocating hair brush units are intended to provide a brushing and massaging action whereby twisted hair is effectively unsnarled as the user traverses the hair with the brush. The brush disclosed herein is purported to provide improved efficiency in operation by effecting the counter-reciprocation of a pair of bristle units wherein the oppositely moving units are intended to effectively pull twisted hair apart as the brushing operation is performed. Unfortunately, such a reciprocating action has been found not to be as advantageous to a detangling operation due to its tendency to damage hair due to the shearing action of the simultaneously reciprocating bristle action.

Other vibrating brush embodiments generally include a singular brush wherein the bristles all move in common, but also include a vibratory movement having a component intended to move towards and away from the user's scalp to apply a beating and massaging action to the scalp. Over time, a beating motion to the scalp can become unpleasant to the user and provides only a limited effect in the actual detangling of the hair, having primarily a massaging purpose.

Yet another problem with most prior vibrating hair brush devices is the communication of the vibrations through the handle to the hand of the user. The hand can function as a substantial dampening force on the vibratory movement, thereby reducing its effectiveness, and also, over time, the absorption of the vibrations by the hand can become uncomfortable and unpleasant to the user. U.S. Pat. No. 2,465,250 discloses soft cushions 7, 11 in a vibratory hair brush providing a floating support for edges of a brush plate but are limited in their usefulness due to their structural position relative to the vibrating actuator and the bristles, and thus, also in purposeful translation of the actuator vibrations to a desired bristle movement.

Accordingly, there is a need for a vibrating hair brush for improved detangling of curled or twisted or knotted hair which operates in a selected plane for improved effectiveness in the detangling with minimum hair damage and which is comfortable to both a user's hand and scalp during operation.

SUMMARY

According to aspects illustrated herein, there is provided a vibrating hair brush for enhanced detangling of the user's hair having a bristle pad comprising a plurality of bristles disposed in a brush head. In this description, it should be understood that the term "vibrating" should be understood to include oscillating and the term "brush" should be understood to include embodiments that might alternatively be described as combs. The bristle pad is supported within the brush head by a vibrating motor and isolator assembly disposed for directing a vibratory movement of the motor to a bristle pad movement in a plane generally parallel to a user's scalp. The motor and isolator assembly effectively translate a circular vibratory movement of an offset weight into an elliptical movement of the bristle pad while insulating the vibration caused by the movement of the weight from a handle of the brush. The elliptical movement has a greater axis in a direction perpendicular to an extending direction of a user's hair.

The vibrating motor and isolator assembly includes an elastomeric interface having a first stiffness in the handle axial direction and a second stiffness perpendicular to the handle axial direction, both of these directions being in a plane generally parallel to a user's scalp. It is preferred that the first stiffness is less than the second stiffness so that the elliptical movement generated has a longer elliptical axis in the handle axial direction.

BRIEF DESCRIPTION OF THE DRAWINGS

FIG. 1 is a top planar view of one embodiment;

FIG. 2 is a side planar view of the embodiment of FIG. 1;

FIG. 3 is a front planar view thereof;

DETAILED DESCRIPTION

The subject embodiments of a vibrating hair brush provide a solution to the needs of better detangling hair with less effort and less damage to a user's hair while detangling. A positive experience is effectively provided to the user as a result of a less painful brushing operation for more enjoyable detangling of the hair than in previous systems. The hair is not being "ripped out" or damaged during the brush detangling, but is gently detangled with less pulling as a result of a lower frequency and gentler detangling operation with the subject vibrating detangling brush. The brush works out the tangles itself as a result of the particular vibratory movement, thereby avoiding the user having to substantially pull hair in an effort to accomplish the desired detangling. Hand fatigue is also substantially reduced during use.

With reference to FIGS. 1, 2 and 3, it can be seen that the subject embodiment comprises a handle portion A and brush head portion B. In this description, it should be understood that the term "brush" encompasses embodiments that might alternatively be described as combs. The handle portion is ergonomically configured for ease of use while being held in a user's hands. A longitudinal axis of handle A is generally along the lines C-C of FIG. 1. The brush head portion B comprises a plurality of bristles 10 which normally extend from a bottom wall 12 of the head portion in a manner to engage and extend through the hair of a user. The illustrated embodiment shows a somewhat spherically configured bottom wall 12 as one species of an embodiment, but it is intended that other bottom wall configurations can be included as an alternative embodiment, such as flat or tubular.

Bristle stiffness can vary from relatively stiff to soft, although it is preferred that they are relatively stiff; the bristles typically having a cantilevered beam stiffness of greater than about 100 Newton/meters when attached to the bristle pad.

As will be discussed herein in more detail, the head portion B is intended to vibrate and such vibratory movements are insulated from the handle portion A so that the vibrations are diminished in translation to the handle and a user's hand. For the avoidance of doubt, the term "vibrating movement" should be understood to include an oscillating or reciprocating movement. Accordingly, a brush head upper housing comprising a top wall 14 is spaced from the handle as at area 16 to accommodate the vibratory movement without tapping contact to the handle portion A.

Figure 4:
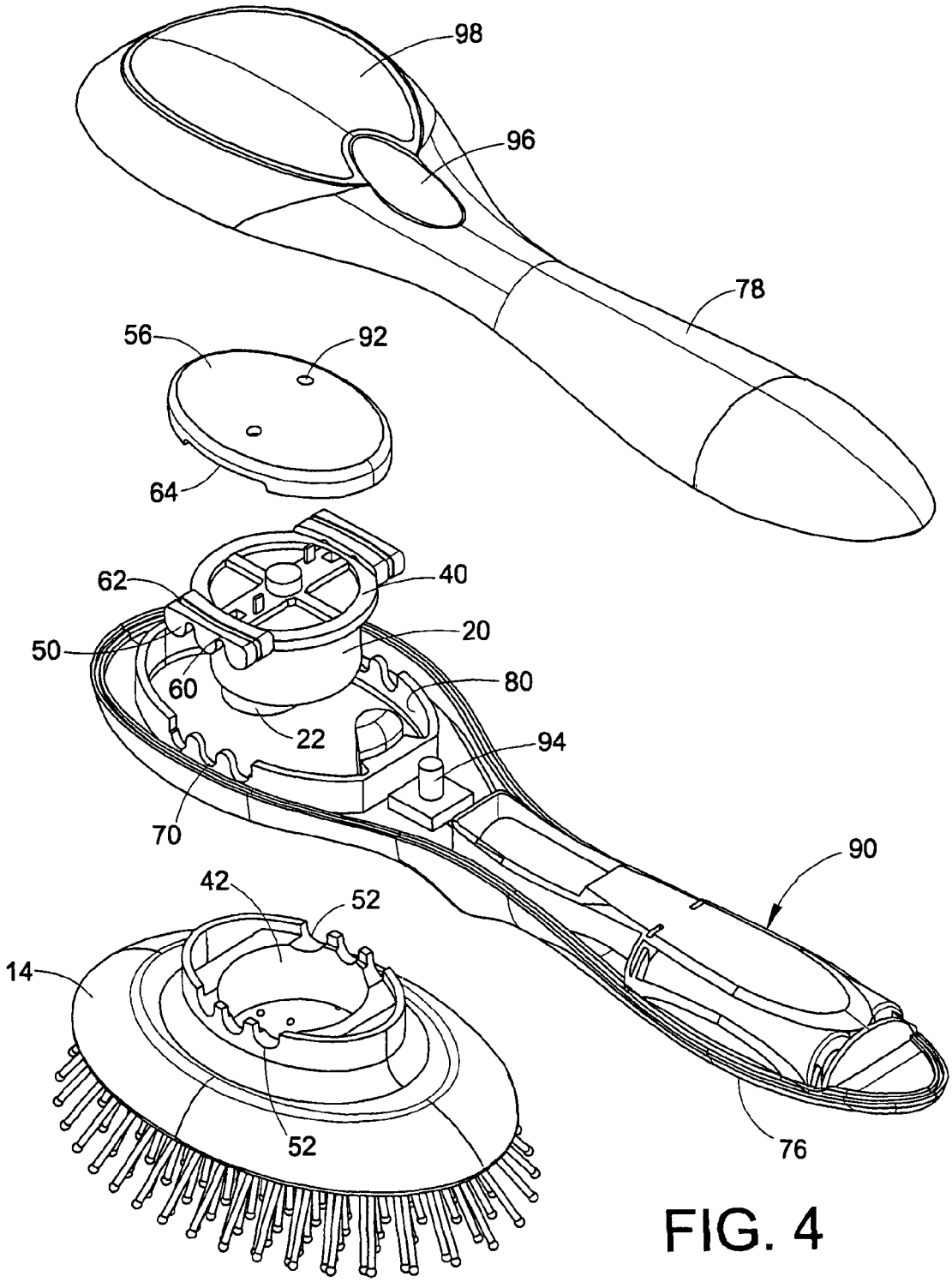
FIG. 4 is an exploded view of the embodiment of FIG. 1.
Figure 5:
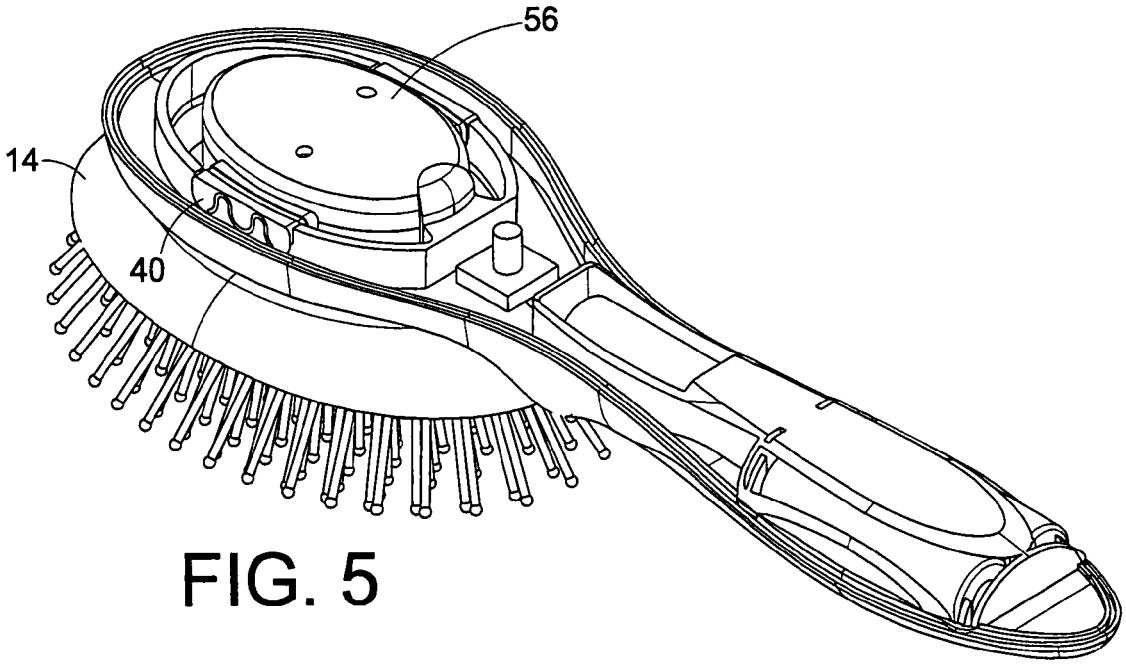
FIG. 5 is a top view with a top cover plate removed.
Figure 6:
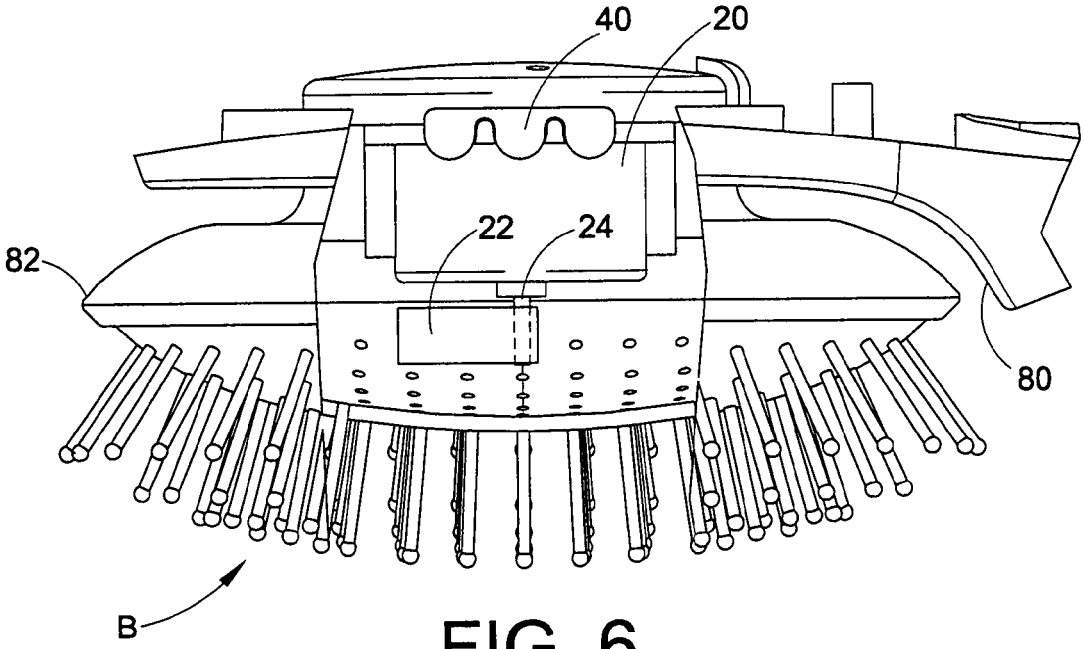
FIG. 6 is a broken out sectional side view.

With reference to FIGS. 4, 5 and 6, the subject brush includes a motor 20 operating an actuator 22 comprising an offset or counter weight relative to motor shaft 24 so that as the motor rotates the shaft, the weight 22 will cause an eccentric bias relative to the shaft inducing a vibrating movement of the motor and weight assembly. Such a movement will generally have a circular momentum in an actuator plane essentially parallel to a plane defined by the lines C-C and D-D of FIG. 1. In this description, it should be understood that the term "brush" encompasses embodiments that might alternatively be described as combs.

An aspect of the subject embodiment includes the translating of the motor and weight circulatory vibratory motion into a curvilinear pattern, such as an elliptical movement, of the bristle pad in a particular plane of movement. An isolator elastomeric member 40 is affixed to the motor 20 and also affixed to the bristle pad assembly 10, 12, 14 so that the vibratory motion induced by the motor can be translated to the bristles 10. The motor 20 is received within a cavity 42 of the bristle pad head portion sized to allow receipt of the motor 20 and the rotational movement of the offset weight 22 that causes the desired vibratory movement. The vibrations created by the off center weight are transmitted to the brush head 14 due to the motor and weight assembly being connected to the brush head by hard, stiff connections. The isolators 40 allow this motion to exist by letting the head move mostly independently from the handle by close receipt of the isolator ring lobes 50 within mating lobe cutouts 52 and the clamping of the lobes within the cutout 52 by sandwiching the lobes between the brush head 14 and upper motor cap 56. The top wall 14 and cutouts 52 are affixed hard plastic pieces ultimately supporting the bristles 10. The particular configuration of the isolator 40 is such that the lobes are closely received within the cutouts 52 and a webbing 60 includes a slot 62 for close mating reception of cap cutout 64 of fastening cap 56. In addition, the end portions of the elastomeric lobes 50 and webbing 60 are also received within handle portion cutouts 70 so that the isolator 40 effectively isolates the vibratory movement of the head portion away from the handle portion A. As can be seen with reference to FIGS. 5 and 6, the head portion assembly thus can float within the handle portion A because the vibrating actuator and motor assembly including cap 56 is spaced from the interior wall 80 of the handle portion. Except for that portion of the elastomeric ring received within the handle cutouts 70, the ring is affixed within the cutouts 70 when the upper handle half 78 is fastened on to the lower handle half 76. Other items shown within FIGS. 4 and 5 include a battery compartment 90 (although the device could also be a corded), electrical wire passage ways for the motor 92, an on-off switch 94 and a switch pad 96. A decorative cover 98 within the handle 78 covers the motor cap 56.

Although in the illustrated embodiment, the isolator 40 is an elastomeric material, alternatives could include any spring structure capable of producing a similar result, such as an assembly of metal springs, plastic gaskets or other elastic members.

Another aspect of the elastic isolator 40 is that it is configured to translate the circular vibratory movement of the eccentric weight 22 into an elliptical movement in a plane generally parallel to the bristle pad. More particularly, it can be seen that the isolator 40 is not supported along the direction of the axis CC (FIG. 1), but is supported along a line perpendicular to the axial direction (line D-D of FIG. 1). The elastomer thus has a first stiffness in the handle axial direction and a second stiffness perpendicular to the handle axial direction, the first stiffness being less than the second stiffness. The effect of such a mounting assembly is that the vibratory movement of the motor and weight will be greater in a direction along the line C-C than along the line D-D. (See FIGS. 1 and 8) If a user's hair (see FIG. 7) is mostly aligned with line D-D (see FIGS. 1 and 8), then the vibratory movement of the bristles 10 will be to effectively vibrate in a manner having a greater extent perpendicular to the hair's extending direction than along, i.e. parallel, to said direction. This tends to untangle twisted or knotted hair by the bristles separating the hairs by slightly pulling them apart, and even more slightly pushing and pulling the hair in its extending direction for better detangling the hair with less effort and less damage to the hair in the detangling process. A related benefit is that friction between the bristles and the hair, in particular the static friction, is reduced.

With reference to FIG. 6, another aspect of the present embodiments is that the vibratory movement of the head portion B is in a curvilinear plane generally normal to a user's scalp to avoid vibrating the bristles into the scalp, which has been observed to result in an unpleasant sensation to a user. In the perspective view of FIG. 6 the eccentric weight 22 is clearly seen as to how, upon rotation of the motor shaft, an eccentric bias is imposed on the motor 20 and thus also onto the isolator support member 40. However, since the rotation of the weight 22 is merely in an actuator plane generally defined by the engagement line 82 between the upper and lower half shells 12, 14 of the head portion B, the resulting elliptical movement of the bristles 10 is in a plane generally parallel to the actuator plane.

Another aspect of the subject embodiments is that the vibratory movement is intended to operate in a frequency range generally lower than most prior art vibratory brushes. Empirical evidence has determined that highly effective detangling can occur with the vibrating bristles operating in a frequency range between 20-100 Hz and more preferably between 30-65 Hz, with the most efficient detangling of the hair, in terms of user effort required to pull the brush through hair, being either one of 42 Hz or 62 Hz. Thus, an improved method for detangling hair comprises brushing the hair with a brush having vibrating bristles operating in a frequency range between 20 to 100 Hz and disposed to operate in a curvilinear direction within a plane positioned generally parallel to a user's scalp, or possibly for longer hair (FIG. 7), an extending plane of a user's hair as the hair extends from a user's scalp. The brushing comprises the bristles operating in an elliptical pattern having a first longer axis of movement in a direction perpendicular to a user's hanging or extending hair direction and a second shorter axial movement parallel to the user's hanging or extending hair direction.

Figure 7:
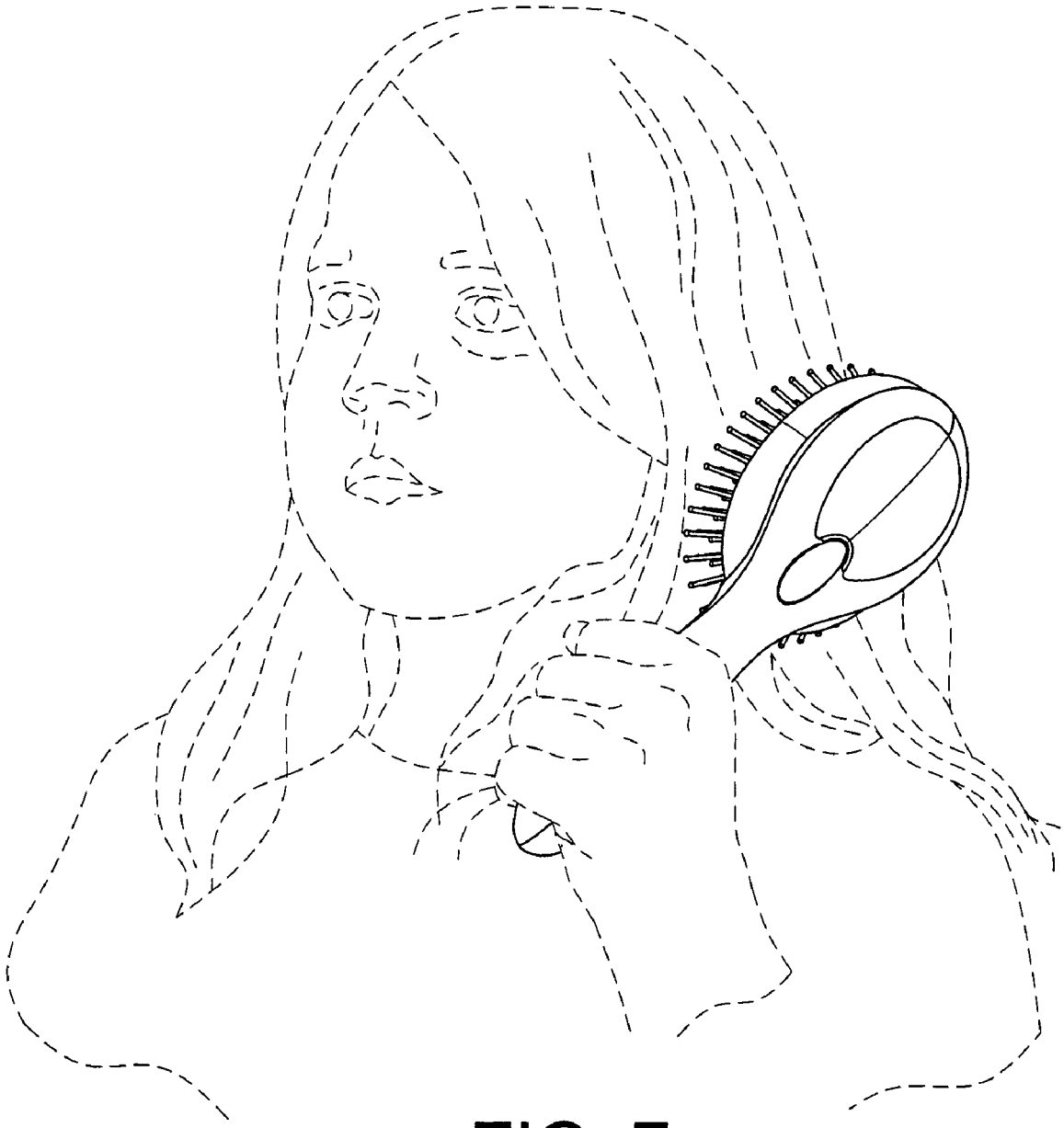
FIG. 7 is a perspective view generally showing the embodiment in use by brushing a user's hair.
Figure 8:
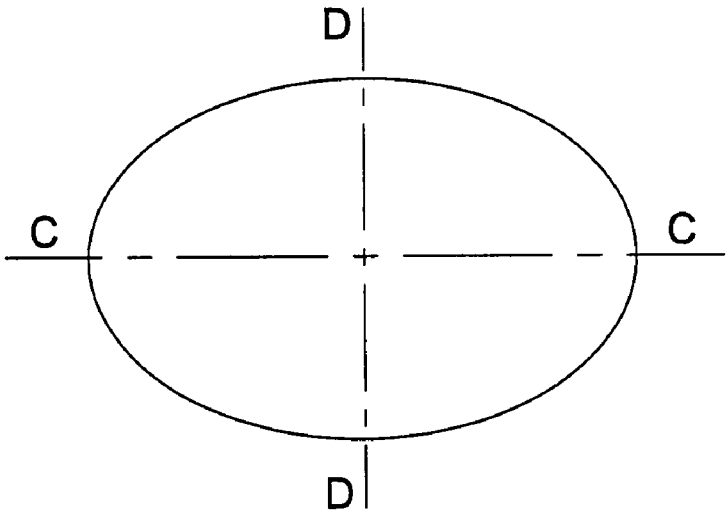
FIG. 8 is a reference diagram of an elliptical plane.
Figure 9:
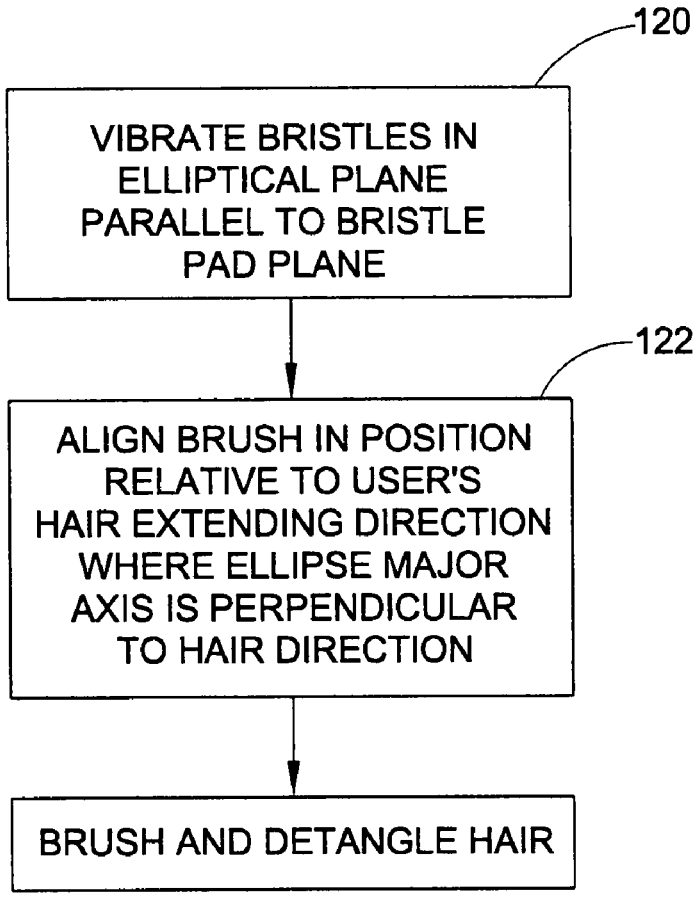
FIG. 9 is a flowchart of a method of operating the embodiment.

With reference to FIGS. 7 to 9, a method of operating the present brush embodiment for enhanced detangling of hair comprises turning on the brush so that the bristles vibrate 120 in the desired elliptical plane parallel to the bristle pad plane 82 (FIG. 6). The brush is then aligned 122 in a position relative to the user's hair so that the extending direction of the hair is generally aligned with axial direction D-D of the brush head, i.e., where the ellipse major axis is perpendicular to the hair direction. Brushing of the hair along the extending direction of the hair will thus provide a detangling effect that is more efficient in the hair detangling with less user effort to pull out the tangles and with minimum fatigue to the user's hand.

For hair that does not normally hang such as shown in FIG. 7, i.e., very curly hair that may extend fairly outwardly from the user's scalp, similar principles apply except that the user's brushing of the hair comprises a pulling along the length of the hair, or a picking thereof, to induce the hair's extending direction outwardly from the scalp, instead of falling therefrom. The present invention is particularly useful with such hair and with hair that is long (i.e. beyond chin length) and with hair that is dry or damaged.

The subject embodiments have also been described with reference to the brushing of human hair, but the subject brush can also be employed to untangle other things such as animal or pet hair or even tangled strands of other materials than hair.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A vibrating hair brush for enhanced detangling of hair, comprising (A) a head portion and (B) a handle portion; the head portion including:

an isolator assembly, a motor assembly for operating a vibrating actuator and a plurality of bristles depending from a bristle pad of the head portion, and the handle portion including a handle extending from the head portion in a handle axial direction within a plane generally parallel to the bristle pad, wherein the actuator comprises an offset weight rotating in a plane generally parallel to the bristle pad and is disposed for generating a vibrating movement of the bristles in a curvilinear direction within a plane generally parallel to the bristle pad and wherein the bristle pad is elastomerically supported by the isolator assembly, and wherein the isolator assembly:

(a) is supported along a line perpendicular to the handle axial direction, (b) is configured to translate a movement of the offset weight to an elliptical bristle pad vibrating movement, and (c) is configured to inhibit vibrating movement in a direction perpendicular to the handle axial direction, and wherein the isolator assembly has a first stiffness in the handle axial direction and a second stiffness perpendicular to the handle axial direction, the first stiffness being less than the second stiffness.

2. The hair brush of claim 1 wherein the vibrating movement is common to some of the bristles.

3. The hair brush of claim 1 wherein the bristle pad comprises a single support for all the bristles for common movement of the bristles.

4. The hair brush of claim 1 wherein the offset weight is mounted on a shaft of the motor assembly for causing an eccentric bias thereto resulting in the vibratory movement.

5. The hair brush of claim 1 wherein the offset weight and motor assembly are fixed to the bristle pad.

6. The hair brush of claim 1 wherein the bristles extend from the bristle pad in a direction generally perpendicular thereto for bristle movement corresponding to the bristle pad elliptical movement.

7. The hair brush of claim 1 wherein the vibrating movement is in a frequency range 20-100 Hz.

8. The hair brush of claim 7 wherein the frequency is in the frequency range 30 to 65 Hz.

9. A method for detangling hair comprising brushing the hair with a vibrating brush according to claim 1, the vibrating brush having vibrating bristles operating in a frequency range between 20 to 200 Hz and disposed to operate in a curvilinear direction within a plane positioned generally parallel to an extending plane of a user's hair as the hair extends from a user's scalp.

10. The method of claim 9 wherein the brushing comprises the bristles operating in an elliptical pattern having a first longer axis of movement in a direction perpendicular to a user's extending hair direction and a second shorter axis of movement parallel to the user's extending hair direction.

* * * * *